US007959221B2

(12) United States Patent
Anglese

(10) Patent No.: US 7,959,221 B2
(45) Date of Patent: Jun. 14, 2011

(54) INTEGRATED LINKAGE/PINCH GUARD SYSTEM FOR LEG RESTS

(75) Inventor: Kurt Anglese, Miami, FL (US)

(73) Assignee: B/E Aerospace, Inc., Wellington, FL (US)

( * ) Notice: Subject to any disclaimer, the term of this patent is extended or adjusted under 35 U.S.C. 154(b) by 130 days.

(21) Appl. No.: 12/201,179

(22) Filed: Aug. 29, 2008

(65) Prior Publication Data

US 2010/0052395 A1 Mar. 4, 2010

(51) Int. Cl.
*A47C 1/031* (2006.01)
*A47C 1/02* (2006.01)

(52) U.S. Cl. ..... 297/85 R; 297/89; 297/91; 297/69

(58) Field of Classification Search ..... 297/69, 297/75, 84, 89, 91, 256.1
See application file for complete search history.

(56) References Cited

U.S. PATENT DOCUMENTS 2,775,286 A * 12/1956 Vallone ..... 297/84
3,754,547 A 8/1973 Walker
4,083,598 A * 4/1978 Thomas ..... 297/45
4,367,895 A * 1/1983 Pacitti et al. ..... 297/85 L
4,534,587 A 8/1985 Fleming
5,129,701 A * 7/1992 Pine ..... 297/68
5,156,441 A * 10/1992 Byersmith et al. ..... 297/423.28
5,503,453 A * 4/1996 Saul et al. ..... 297/89
5,582,457 A * 12/1996 Komorowski et al. ..... 297/75
5,695,239 A * 12/1997 Johnson et al. ..... 297/69
5,845,961 A * 12/1998 LaPointe et al. ..... 297/75
6,540,291 B2 * 4/2003 Hoffman et al. ..... 297/85 R
6,572,185 B1 6/2003 Tseng
7,396,074 B2 * 7/2008 Wiecek ..... 297/85 L
7,445,279 B2 * 11/2008 Crum ..... 297/84
7,766,421 B2 * 8/2010 Lawson ..... 297/85 R

* cited by examiner

*Primary Examiner* — Sarah B McPartlin
(74) *Attorney, Agent, or Firm* — Drinker Biddle & Reath LLP

(57) ABSTRACT

A four-bar linkage system for a chair having a leg rest extension, the linkage system having a first set of linkage members of irregular geometric shapes connected at one end to an outboard portion of a leg extension platform and at a second end to a seat member. A second set of linkage members of irregular geometric shapes is connected to the first set of linkage members and at one end to an inboard portion of the leg rest platform and at a second end to the seat member.

12 Claims, 12 Drawing Sheets

INTEGRATED LINKAGE/PINCH GUARD SYSTEM FOR LEG RESTS

BACKGROUND OF THE INVENTION

Conventional aviation seats having leg rests utilize a scissors-like four-bar linkage to support the leg rest platform. These leg extension linkage systems are predominately comprised of linkage members of the same size and shape that are crossed with one another so as to act in an accordion fashion when the leg rest was extended or retracted. Upon extension of the leg rest, the crossed linkage member extended from one another to form an X, thereby allowing the leg rest to extend away from the seat member. When the leg rest is retracted, the linkage members pivoted about their ends and a central connecting point that joins two members together in an X-shaped fashion. This allows for the linkage members to line up and retract against one another, thereby retracting the leg rest into the seat.

The relative movement between the linkage members presents a potential finger pinch opportunity during leg rest deployment and stowage. Currently, separate, folding, planar pinch guards are layered between the links to shield fingers from entering these "pinch points." When viewed from the side of the leg rest, these guards effectively shield any opening large enough for a finger to enter.

The pinch guards pivot on the same axes as the links, and are custom profiled for each unique linkage system design. This protection results in added system complexity due to additional components and fasteners, joint friction, stack-up width, clearance and weight requirements, and assembly and service labor time. For these reasons, an integrated linkage/pinch guard system that eliminates the need for separate pinch guards would be an important improvement in the art.

BRIEF DESCRIPTION OF THE DRAWINGS

FIG. 4(*a*) is a front view showing the frame of a leg rest and leg rest extension linkage system in a fully retracted position.

FIG. 10(*b*) is a perspective view showing a spacer between linkage members and sets of linkage members that make up the leg rest extension system.

DETAILED DESCRIPTION OF THE EMBODIMENTS

Figure 1:
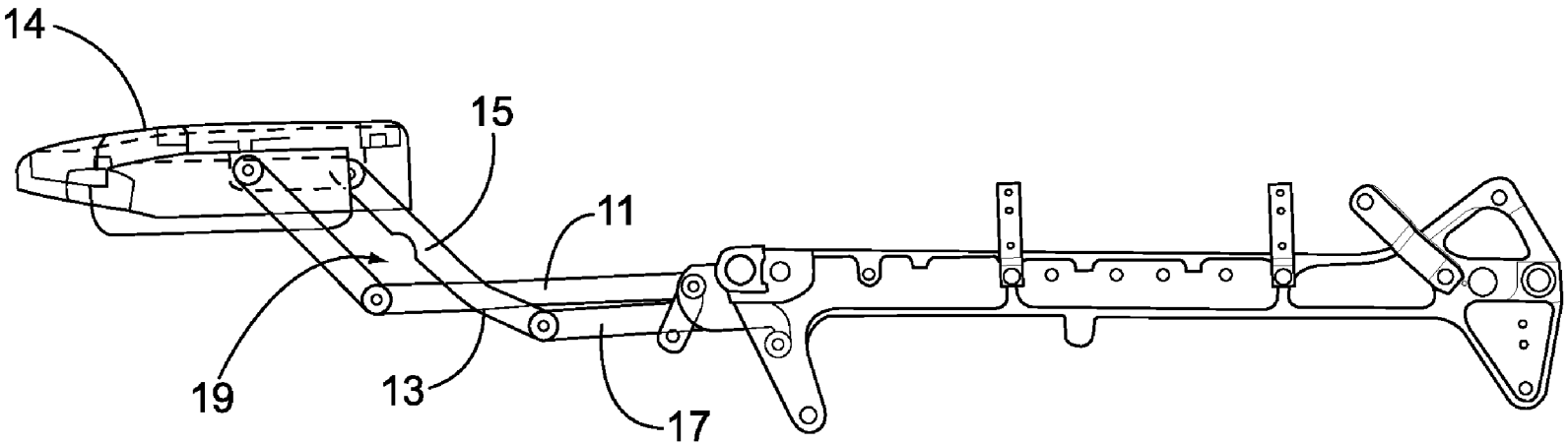
FIG. 1 Prior Art
FIG. 1 is a side view of the leg rest extension linkage system of the prior art.

FIG. 1 shows the prior art four-bar linkage system that involves two sets 11, 13 of straight edge linkage members 15, 17. The two sets 11, 13 are pinned together and the linkage members 15, 17 of each set pivot around one another to extend and retract a leg rest platform 14. The linkage members 15, 17 are pinned together in such a way that little or no space existed between the individual members 15, 17 or the two sets 11, 13 of members. Given this arrangement, it was easy for an individual to get their fingers pinched or caught in the pinch points (e.g., 19) located between the extension members 15, 17 as the leg rest platform 14 was extended or retracted.

Figure 2:
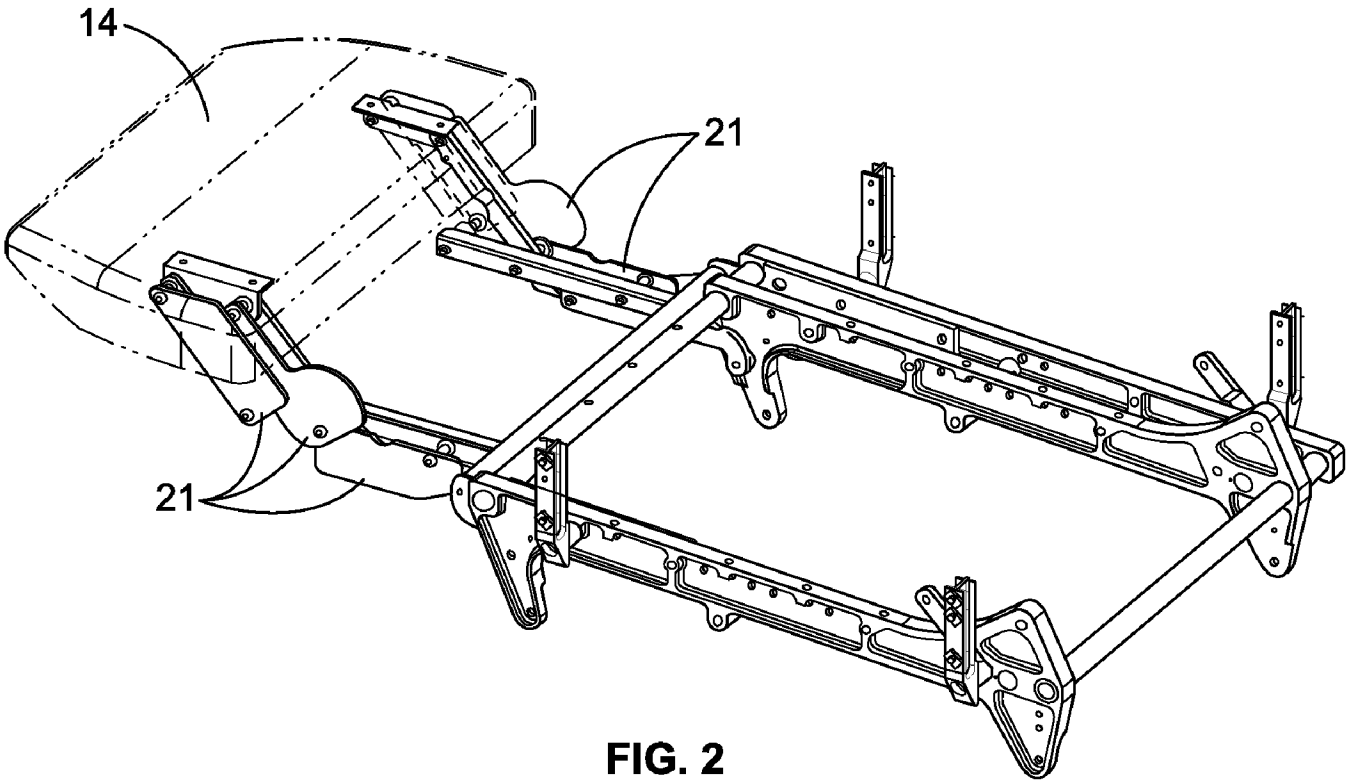
FIG. 2 Prior Art
FIG. 2 is a perspective view showing a leg rest extension system in which pinch guards have been installed on the linkage system.

As shown in FIG. 2, plastic covers 21 have been used in an attempt to protect one from having their fingers caught in the pinch points.

Figure 3:
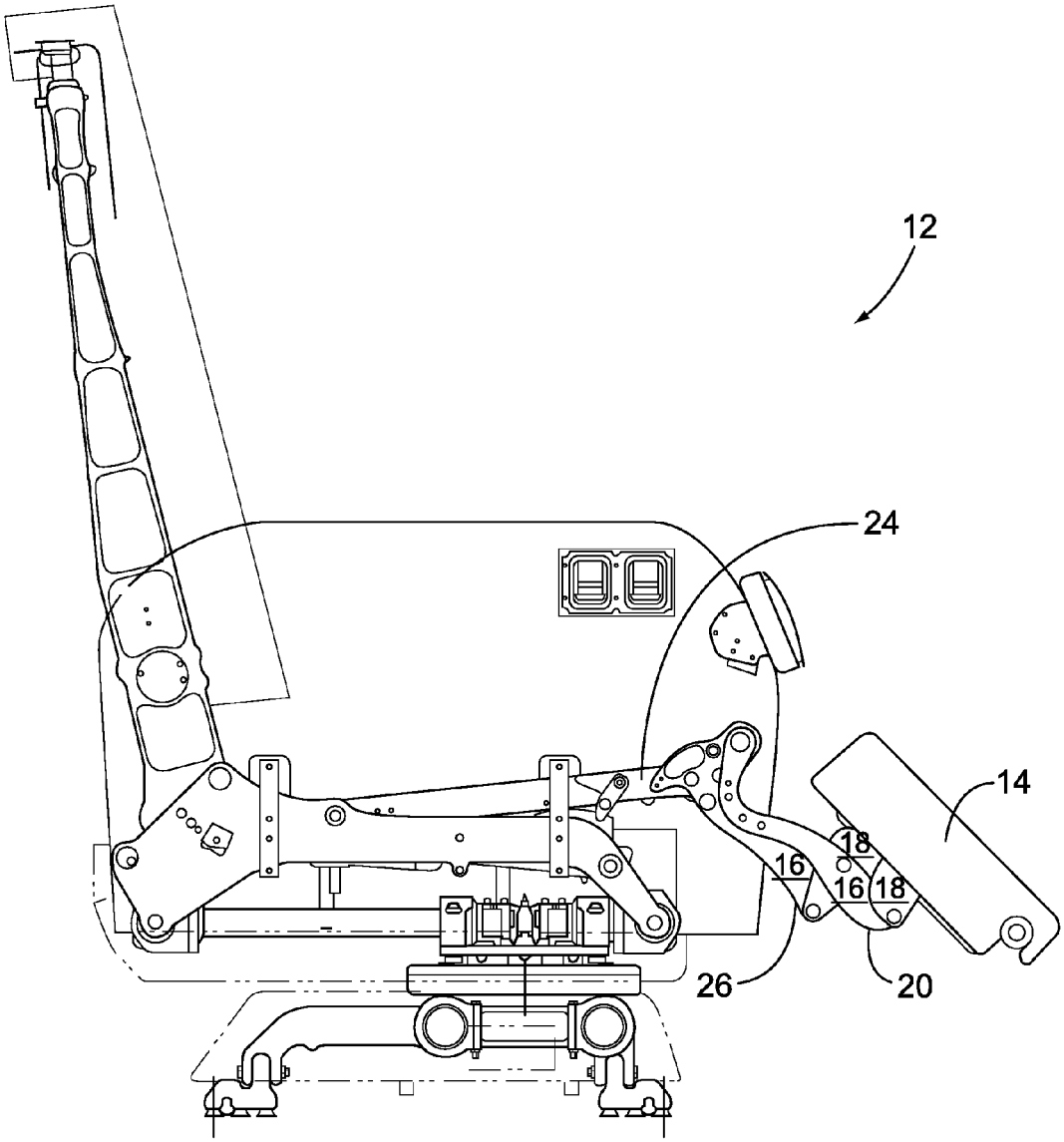
FIG. 3 is a cut-away view of a seat having a leg rest extension platform.
Figure 4:
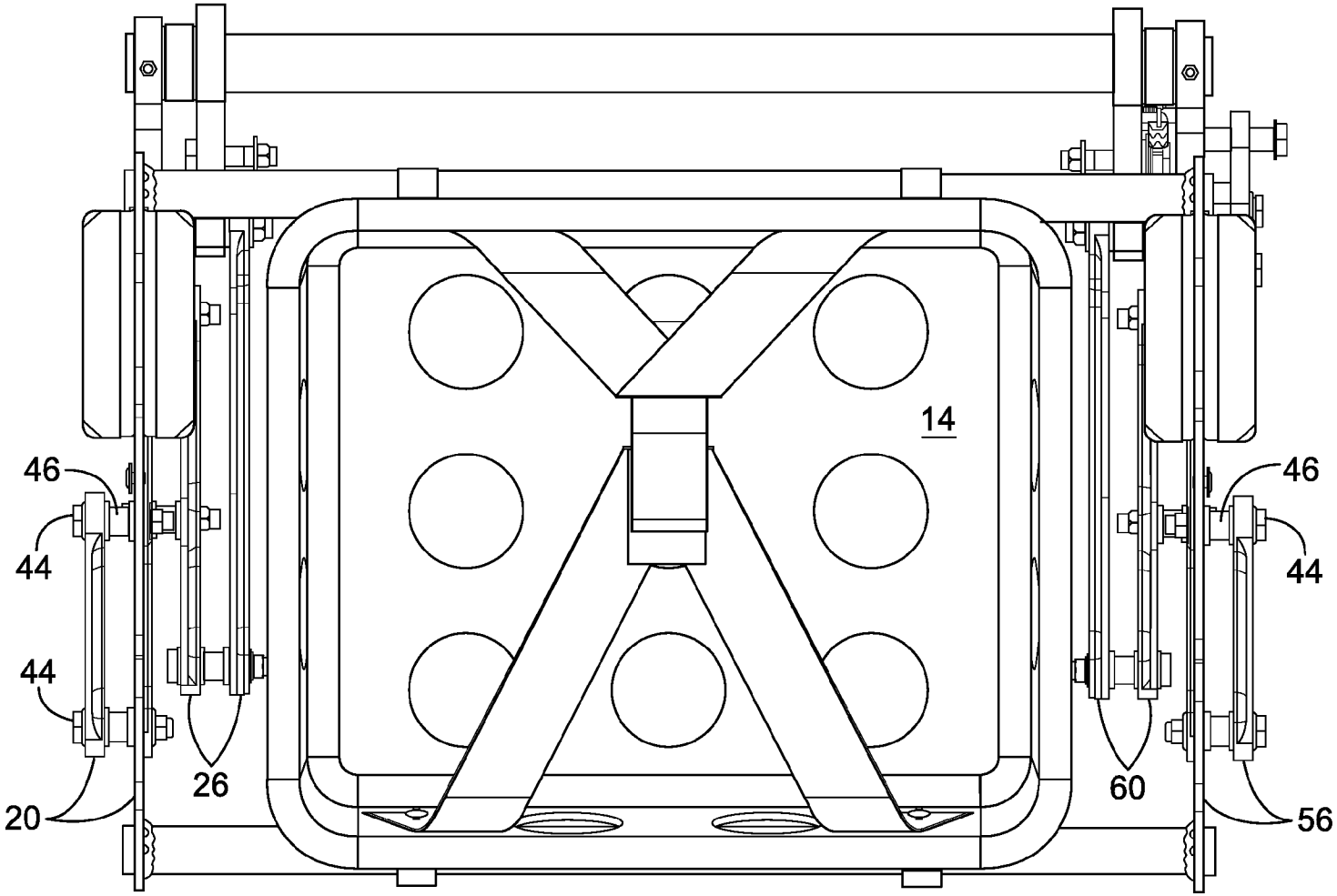
FIG. 4 is a front view showing a leg rest and a leg rest extension linkage system in a fully retracted position.
Figure 4A:
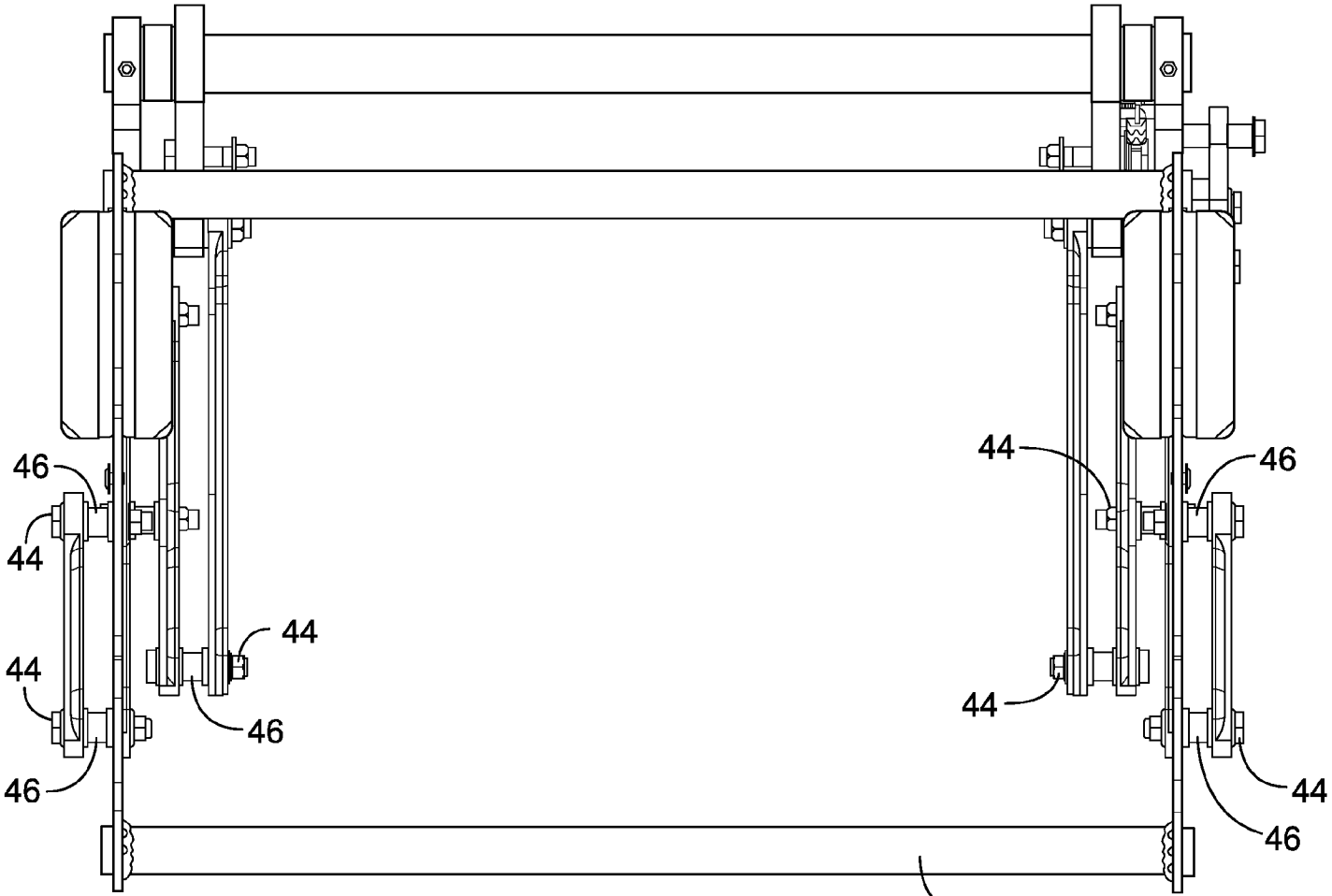
Figure 5:
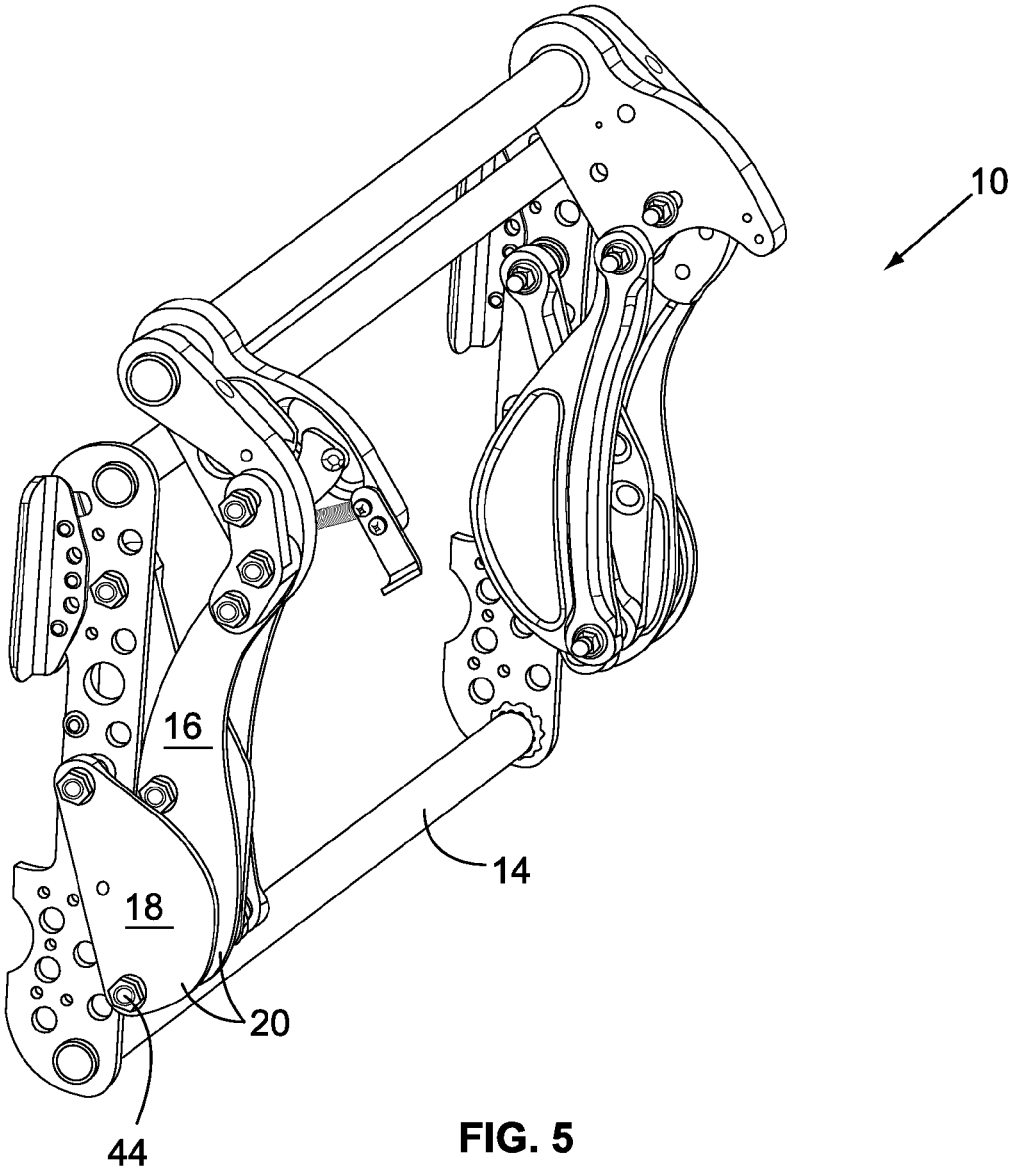
FIG. 5 is a perspective view showing the leg rest and the leg rest extension linkage system in a fully retracted position.
Figure 6:
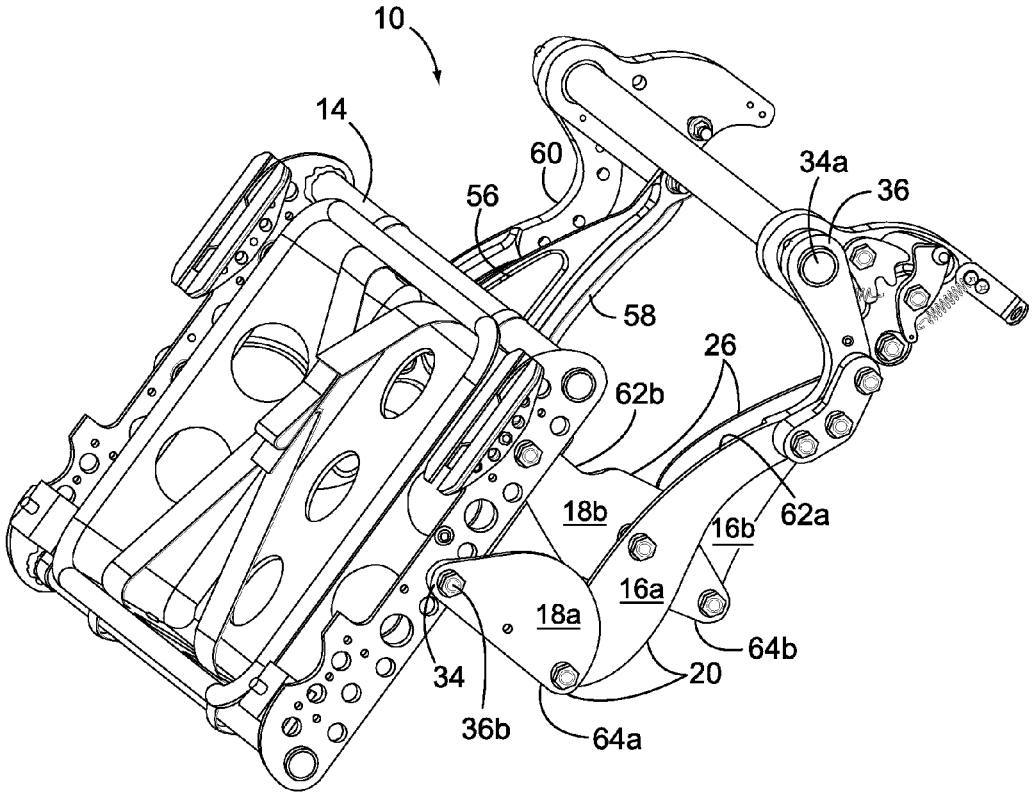
FIG. 6 is a perspective view of a leg rest and a leg rest extension linkage system in a partially open position.
Figure 9:
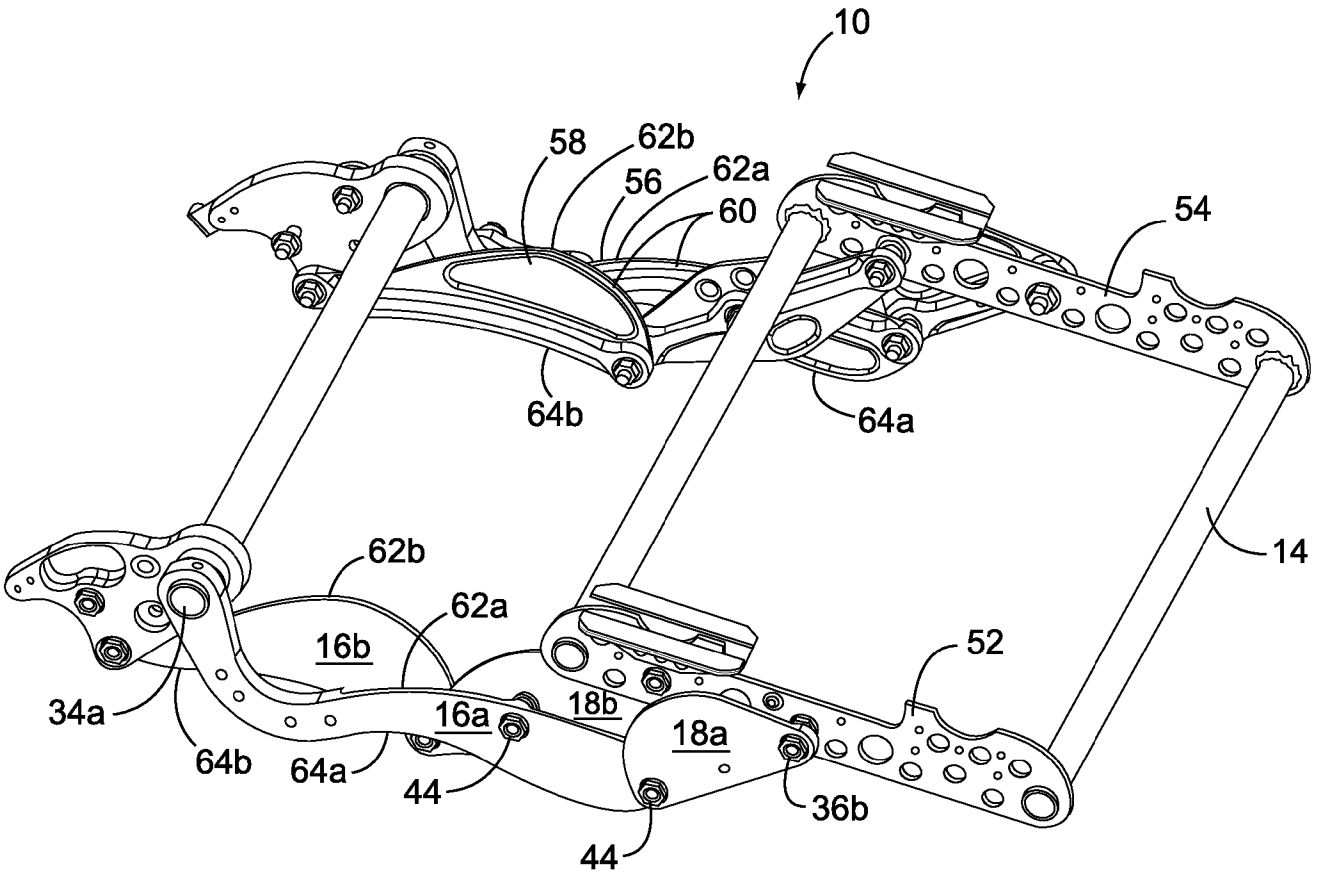
FIG. 9 is a perspective view of the leg rest extension linkage system in a fully open position.

As shown in FIGS. 3, 4, 4(*a*), 5, 6, 7, 8, 9, 10(*b*), and 11, the claimed apparatus involves a four-bar linkage system 10 for a chair 12 having a leg rest extension platform 14. As shown in FIGS. 6 and 9, the linkage system 10 is comprised of a first set 20 of two linkage members 16(*a*), 18(*a*) of irregular geometric shapes. This first set 20 is connected at one end 34 to a leg rest platform 14 and at a second end 36 to a seat member 24. A second set 26 of two linkage members 16(*b*), 18(*b*) of irregular geometric shapes is connected to the first set 20 of linkage members 16(*a*), 18(*a*) and, one end 28 of the second set 26 is connected to the leg rest platform 14 and a second end 32 to the seat member 24. Each of the first and second sets 20, 26 of linkage members 16*a*, 18*a*, and 16*b*, 18*b* has an upper edge 62*a*, 62*b*, respectively, and a lower edge 64*a*, 64*b*, respectively, and the upper edge 62*a* of the first set of linkage members 20 overlaps the lower edge 64*b* of the second set of linkage members 26 when the linkage system 10 is in an extended position, thereby preventing any lateral openings.

In an embodiment, each linkage member of the first and second sets of linkage members 20, 26 has a first end 34 and a second end 36, the first end 34(*a*) of one of the linkage members 16 of each set of linkage members 20, 26 is pivotally attached to the chair 12, and the second end 36(*b*) of a second one of the linkage members 18 of each set of linkage members 20, 26 is pivotally attached to a leg rest platform 14. In a particular version of the embodiment, the first of one of the linkage members of each set of linkage members 20, 26 is pivotally attached to an attachment point proximal to the chair 12. Each of these linkage members 16, 18 has a smoothly profiled outer edge 38, as shown in FIGS. 5-9.

Figure 10B:
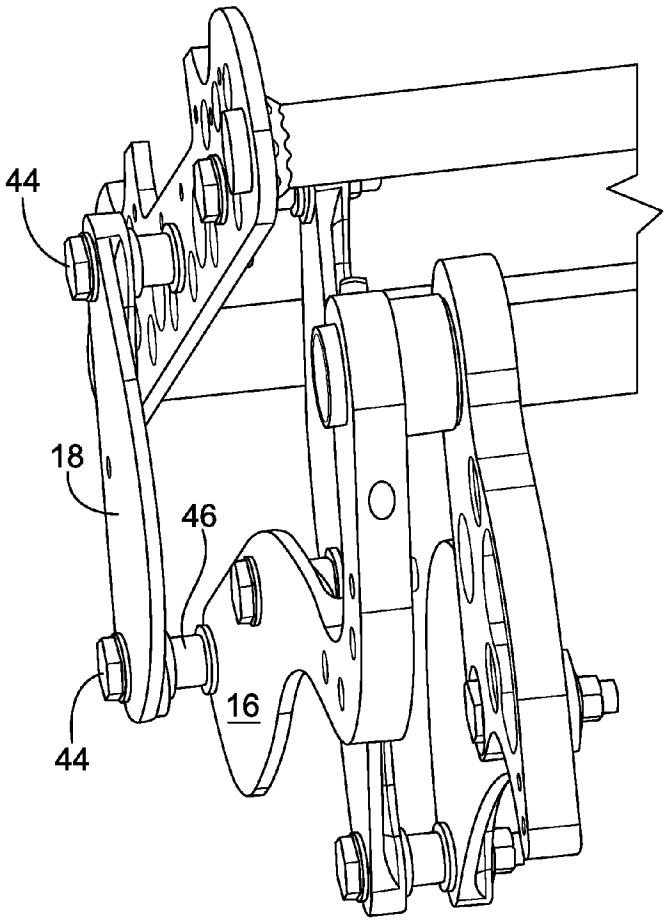
FIG. 10(*a*) is a sectional view of a spacer and connecting bolt used with the leg rest extension system.
Figure 10A:
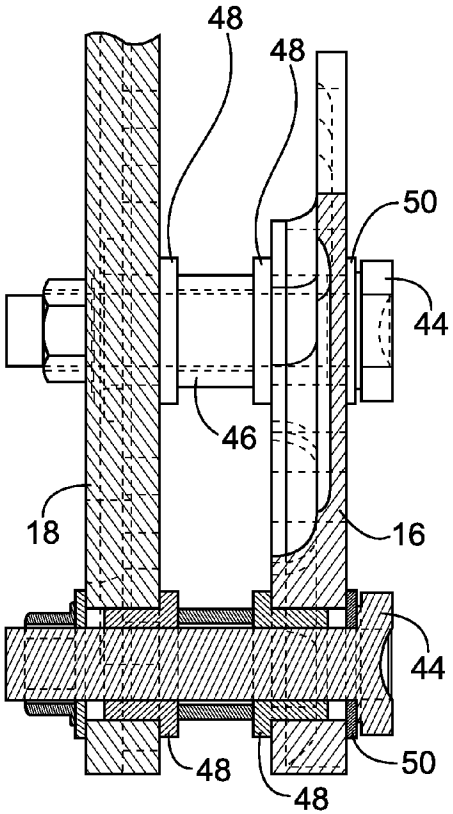

Each linkage member 16, 18 in each set of linkage members 20, 26 is displaced from one another. A connecting bolt 44 pivotally connects each linkage member 16, 18 to one another and a spacing member 46 maintains the displacement between each of the connected linkage members 16, 18. As shown in FIGS. 10(*a*) and 10(*b*), a conventional spacer 46 is used along with a standard bolt 44. The spacer 46 has a flange 48 on each end that fits in a shoulder bushing 50 attached to a linkage member 16, 18. The first and second sets of linkage members 20, 26 are also displaced from one another. At least one connecting bolt 44 pivotally connects the first set of linkage members 20 to the second set 26, and a spacing member 46 maintains the displacement between the connected first and second set 20, 26 of linkage members. At least one connecting bolt 44 pivotally connects the first set of linkage members 20 to the second set 26, and a spacing member 46 maintains the displacement between the connected first and second set 20, 26 of linkage members.

In an embodiment, each of the linkage members 16, 18 are displaced from one another by a distance of at least ⅜ of an inch while the first and the second set of linkage members 20, 26 are displaced from one another by a distance of at least ⅜ inches. This spacing between the linkage members 16, 18 and the first and second set of linkage members 20, 26 allows one's finger to pass through the linkage without injury should it inadvertently become caught in the linkage system 10.

In still another embodiment, each of the linkage members 16, 18 has a different geometric shape. These geometric shapes are not merely a design choice, but allow for a person's finger to be guided out of a pinch point.

In yet another embodiment, the leg rest platform 14 has a first side 52 and a second side 54, and a second four-bar linkage system 56 comprised of a third 58 and fourth 60 set of linkage members of irregular geometric shapes is connected to each other and to the second side 54 of the leg extension platform 14 opposite the first system 10. In a particular version of this embodiment, the third and fourth set of linkage members 58, 60 are displaced from one another by a distance of at least ⅜ of an inch.

In an embodiment, a spacer 46 separates the first set of linkage members 58 from the second set of linkage members 60. The spacer 46 may be constructed of aluminum or any other suitable material. As shown in FIGS. 10(*a*) and 10(*b*), the spacer has a first end and a second end. Each end of the spacer 46 is mated to a flange bushing 48 with said flange bushings 48 being pressed into a linkage member of a respective first and second linkage set 58, 60.

Figure 7:
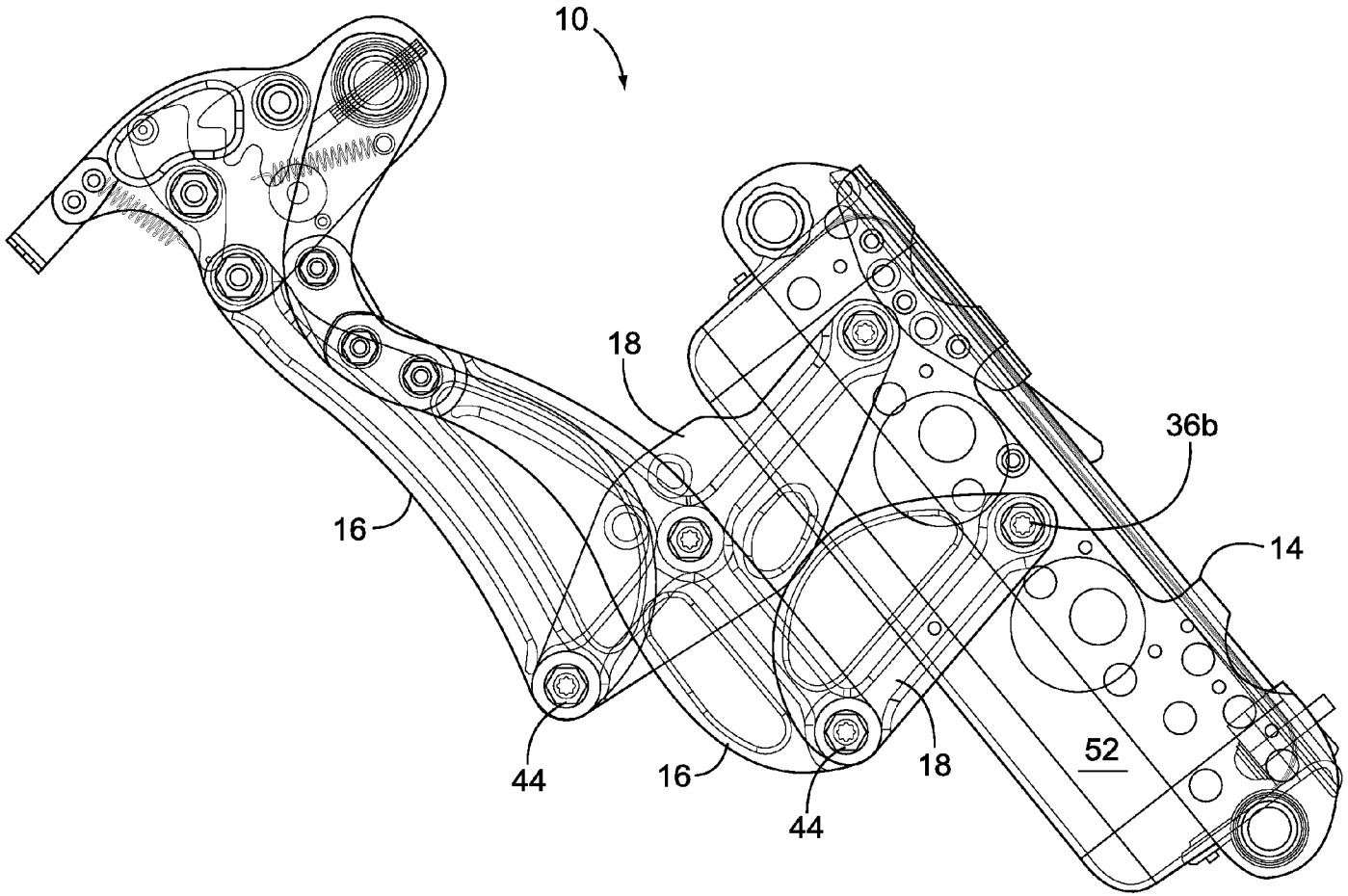
FIG. 7 is a sectional side view of a leg rest and leg rest extension linkage system in a partially open position.
Figure 8:
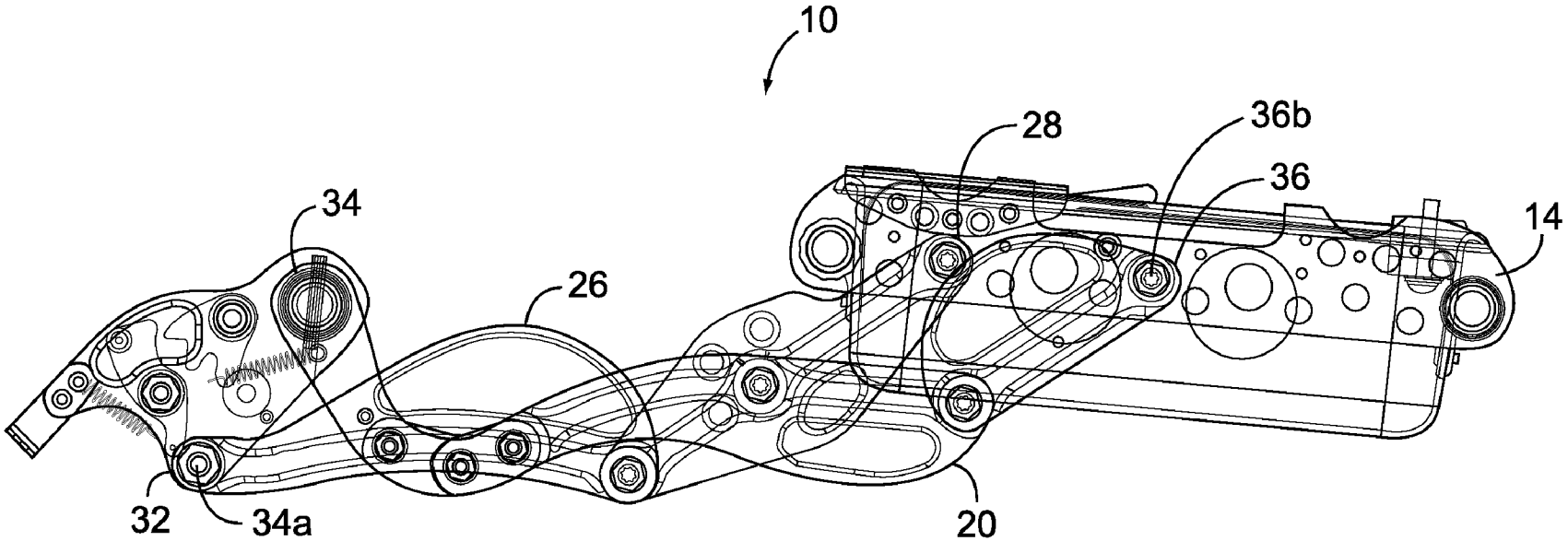
FIG. 8 is a sectional side view of a leg rest and a leg rest extension linkage system in a fully open position.
Figure 11:
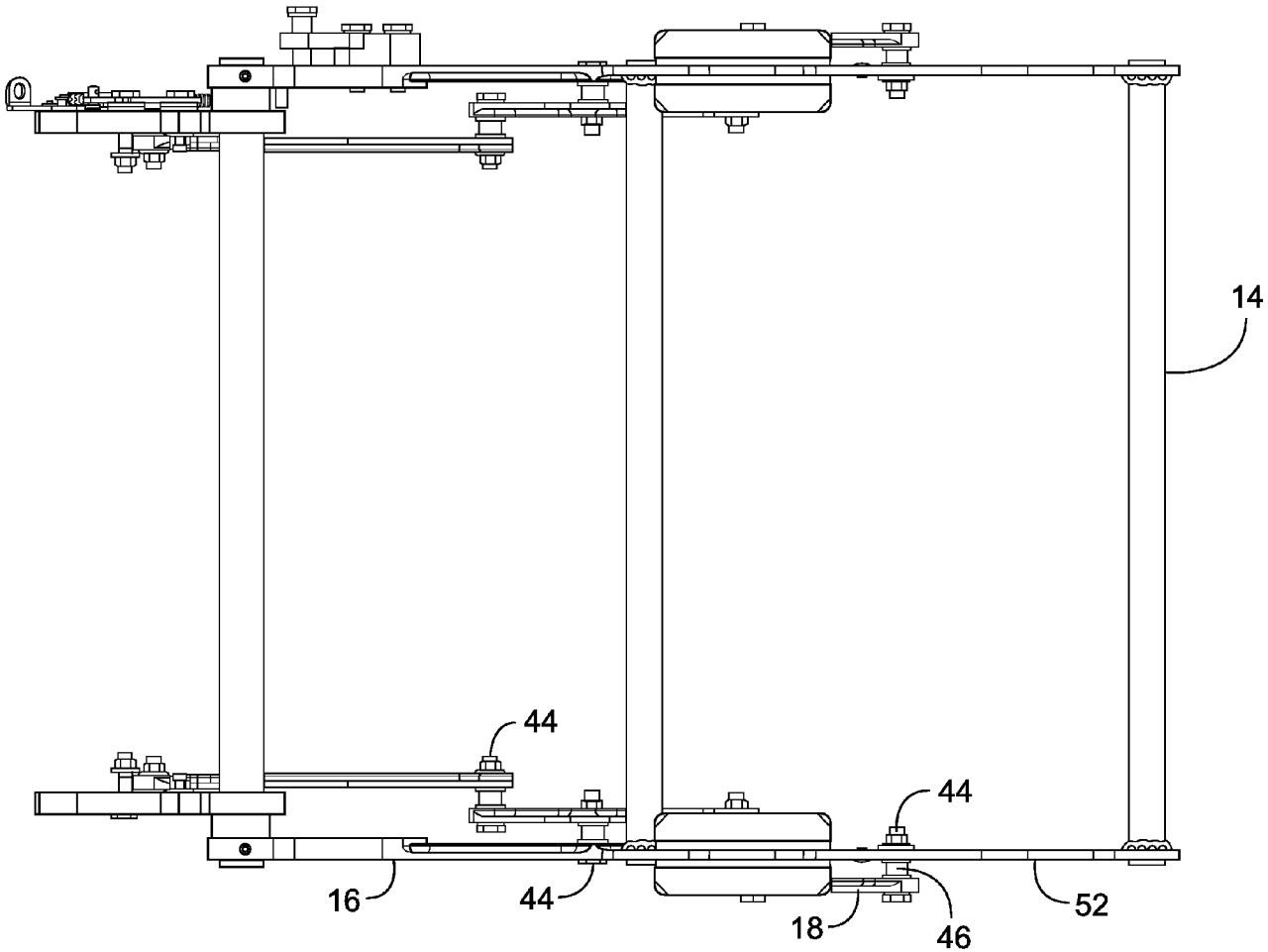
FIG. 11 is a top view showing the leg rest extension linkage system in a fully open position.

When in operation, a person sitting in the chair 12 having the linkage system 10 activates the linkage system 10 either manually or automatically in a manner known in the art. This causes to leg rest platform 14 to move from a fully retracted position as shown in FIGS. 4, 4(*a*) and 5, through a midway position, as shown in FIGS. 6 and 7, to a fully open position shown in FIGS. 8, 9, and 11.

The irregular shape of the linkage members 16, 18 allows them to be displaced from one another at their point of connection. This along with their smoothly profiled outer edge allows the members 16, 18 to be retracted and extended without creating pinch points that could catch and cause serious injuries to a person should they get their fingers caught within the linkage.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A pinch-resistant four bar linkage system for a chair having a leg rest extension, the linkage system comprised of:

a first set of two linkage members of irregular geometric shapes having non-parallel opposed edges, said first set connected at one end to a leg rest platform and at a second end to a seat member, each linkage member in said first set of linkage members is displaced from one another and pivotally connected to one another by a connecting bolt, while a spacing member maintains the displacement between each of the connected linkage members; and a second set of two linkage members of irregular geometric shapes having non-parallel opposed edges, where said second set is connected to the first set of linkage members and one end of the second set is connected to the leg rest platform and a second end to the seat member, each linkage member in said second set of linkage members is displaced from one another and pivotally connected to one another by a connecting bolt, while a spacing member maintains the displacement between each of the connected linkage members, wherein the linkage system is movable between a stowed position in which the leg rest platform is proximate to the seat member and an extended position in which the leg rest platform is distal to the seat member such that no lateral opening is formed between opposed edges of any of the irregularly shaped linkage members when the linkage system is in the extended position.

2. The linkage system of claim 1, wherein:

each linkage member of the first and second sets of linkage members has a first end and a second end;

the first end of one of the linkage members of each set of linkage members is pivotally attached to the chair; and the second end of a second of the linkage members of each set of linkage members is pivotally attached to a leg rest.

3. The linkage system of claim 2, wherein:

the first end of one of the linkage members of each set of linkage members is pivotally attached to an attachment point proximal to the chair.

4. The linkage system of claim 1, wherein each of the linkage members has a smoothly profiled outer edge.

5. The linkage system of claim 1, wherein each of the linkage members are displaced from one another by a distance of at least ⅜ of an inch.

6. The linkage system of claim 1, wherein each of the linkage members has a different geometric shape.

7. A pinch-resistant four bar linkage system for a chair having a leg rest extension, the linkage system comprised of:

a first set of two linkage members of irregular geometric shapes having non-parallel opposed edges, said first set connected at one end to a leg rest platform and at a second end to a seat member;

a second set of two linkage members of irregular geometric shapes having non-parallel opposed edges, where said second set is connected to the first set of linkage members and one end of the second set is connected to the leg rest platform and a second end to the seat member;

the first and second sets of linkage members are displaced from one another;

at least one connecting bolt pivotally connects the first set of linkage members to the second set; and a spacing member maintains the displacement between the connected first and second set of linkage members, wherein the linkage system is movable between a stowed position in which the leg rest platform is proximate to the seat member and an extended position in which the leg rest platform is distal to the seat member such that no lateral opening is formed between opposed edges of any of the irregularly shaped linkage members when the linkage system is in the extended position.

8. A pinch-resistant four bar linkage system for a chair having a leg rest extension, the linkage system comprised of:

a first set of two linkage members of irregular geometric shapes having non-parallel opposed edges, said first set connected at one end to a leg rest platform and at a second end to a seat member; and a second set of two linkage members of irregular geometric shapes having non-parallel opposed edges, said second set of linkage members is connected to the first set of linkage members and displaced from said first set by a distance of at least ⅜ of an inch, and one end of the second set is connected to the leg rest platform and a second end to the seat member wherein the linkage system is movable between a stowed position in which the leg rest platform is proximate to the seat member and an extended position in which the leg rest platform is distal to the seat member such that no lateral opening is formed between opposed edges of any of the irregularly shaped linkage members when the linkage system is in the extended position.

9. A pinch-resistant four bar linkage system for a chair having a leg rest extension, the linkage system comprised of:

a first four bar linkage system comprised of:

a first set of two linkage members of irregular geometric shapes having non-parallel opposed edges, said first set connected at one end to a first side of a leg rest platform and at a second end to a seat member;

a second set of two linkage members of irregular geometric shapes having non-parallel opposed edges, where said second set is connected to the first set of linkage members and one end of the second set is connected to the first side of the leg rest platform and a second end to the seat member;

a second four bar linkage system comprised of a third and fourth set of linkage members of irregular geometric shapes that are connected to each other and to a second side of the leg rest platform opposite the first system, said third and fourth set of linkage members being displaced from one another by a distance of at least ⅜ of an inch, wherein both the first and the second four bar linkage systems are movable between a stowed position in which the leg rest platform is proximate to the seat member and an extended position in which the leg rest platform is distal to the seat member such that no lateral opening is formed between opposed edges of any of the irregularly shaped linkage members when the linkage systems are in the extended position.

10. A pinch-resistant four bar linkage system for a chair having a leg rest extension, the linkage system comprised of:

a first set of two linkage members of irregular geometric shapes having non-parallel opposed edges, said first set connected at one end to a leg rest platform and at a second end to a seat member;

a second set of two linkage members of irregular geometric shapes having non-parallel opposed edges, where said second set is connected to the first set of linkage members and one end of the second set is connected to the leg rest platform and a second end to the seat member; and a spacer, distinct from the linkage members, separates the first set of linkage members from the second set of linkage members, wherein the linkage system is movable between a stowed position in which the leg rest platform is proximate to the seat member and an extended position in which the leg rest platform is distal to the seat member such that no lateral opening is formed between opposed edges of any of the irregularly shaped linkage members when the linkage system is in the extended position.

11. The linkage system of claim 10, wherein the spacer is constructed of aluminum.

12. The linkage system of claim 10, wherein:

the spacer has a first end and a second end;

each end of the spacer is mated to a flange bushing;

said flange bushings being pressed into a linkage member of a respective first and second linkage set.

* * * * *